US005926977A

United States Patent [19]

Sanders

[11] Patent Number: 5,926,977

[45] Date of Patent: Jul. 27, 1999

[54] PROTECTIVE FOOTGEAR

[76] Inventor: Joseph H. Sanders, 157 Pinckney St., Summerville, S.C. 29483

[21] Appl. No.: 08/963,961

[22] Filed: Nov. 4, 1997

[51] Int. Cl.[6] ..... A43B 1/02; A43B 3/16; A43B 13/16

[52] U.S. Cl. ..... 36/84; 36/7.1 R; 36/72 R

[58] Field of Search ..... 36/84, 3 B, 3 R, 36/7.1 R, 7.3, 72 R

[56] References Cited

U.S. PATENT DOCUMENTS

| | | |
|---|---|---|
| 2,720,714 | 10/1955 | Krohn et al. . |
| 3,061,951 | 11/1962 | Barron . |
| 3,243,898 | 4/1966 | Lewis, Jr. et al. . |
| 3,516,181 | 6/1970 | Jordan . |
| 3,841,004 | 10/1974 | Gray et al. . |
| 3,973,275 | 8/1976 | Blauer . |
| 4,366,629 | 1/1983 | Scherz . |
| 4,366,630 | 1/1983 | Bloom . |
| 4,503,566 | 3/1985 | Wheeler . |
| 4,611,411 | 9/1986 | Ringler et al. . |
| 5,804,757 | 9/1998 | Wynne . |

FOREIGN PATENT DOCUMENTS 9704675 2/1997 WIPO .

*Primary Examiner*—Ted Kavanaugh
*Attorney, Agent, or Firm*—Maria Reichmanis

[57] ABSTRACT

Protective footgear consisting of a multilayered material shaped into an overshoe that protects the foot and lower leg of the wearer from injury due to exploding land mines. In a preferred embodiment of the invention, the overshoe includes a heat-resistant layer, a water-impermeable layer, and a puncture-resistant layer. It may be formed into an overshoe of conventional appearance, or assembled by cutting and folding a suitable multilayered sheet material into a box-like structure that is worn over the user's regular shoe or boot. The multilayered structure consists of materials that, in combination, substantially dissipate the shock of an exploding land mine and thereby reduce the risk of injury to the wearer. The invention is easy to manufacture of readily-available materials, light-weight, reasonably comfortable to wear while walking, reusable and repairable, and provides remarkably effective protection against blast and shrapnel injuries caused by exploding land mines.

13 Claims, 2 Drawing Sheets

PROTECTIVE FOOTGEAR

BACKGROUND OF THE INVENTION

1. Field of the Invention

The present invention relates to protective apparel. In particular, the present invention relates to multilayered protective footgear that helps reduce the risk of injury to the wearer's feet and lower legs due to detonation of antipersonnel land mines.

2. Discussion of Background

One of the most unfortunate legacies of war is the lingering hazard posed by undetonated land mines (also termed antipersonnel mines). Perhaps as many as one third of the world's countries have a serious land mine problem resulting from past wars, internal conflicts, or terrorist activities. Land mines are cheap (costing as little as $3.00 per mine), easy to use, hard to detect, and, when detonated, capable of inflicting horrendous injuries on combatants and noncombatants alike. Many different types of land mines are available, including the following: blast mines, which burst on contact, are usually small and may injure only the unfortunate person who steps directly onto the mine; bounding mines rocket to a height of several feet above ground before blowing up, thus, frequently injure nearby bystanders as well; directional fragmenting mines can propel shrapnel as far as 200 meters. Information concerning the extent of the worldwide land mine problem is found in the following publications, the disclosures of which are incorporated herein by reference: "Land Mines: Horrors Begging For Solutions," *Chemical & Engineering News,* Mar. 10, 1997, pp. 14–22; "Minefields, Literal and Metaphoric," *U.S. News & World Report*, pp. 39–41, Feb. 3, 1997.

Land mines first came into widespread use during World War II. These early designs used relatively large amounts of explosive (on the order of 300 grams or more) and were designed to kill. Later, in the 1960's, land mines designed to maim and disfigure rather than to kill became available. These new designs typically use much smaller amounts of explosives (on the order of 100 grams) that are sufficient to kill only small children, but can severely maim an older child or an adult.

Land mines have become the antipersonnel weapon of choice for many rebel forces, particularly in places such as Afghanistan, Cambodia, Mozambique, and Zaire. Land mines are deployed whenever and wherever there is a possibility of inflicting injury to humans, combatants and noncombatants alike: in roads, in harbors, at airports, railroad stations, and other places where large numbers of people congregate, and even on farmland, making large areas of otherwise-productive land off-limits to civilians. Some estimates indicate that there are over one hundred million leftover, still-active land mines throughout the world, in over seventy countries; millions more are produced, sold, and used each year. Injuries due to land mine explosions kill or maim people—including children—at a rate of one victim every twenty minutes.

Because of the sheer numbers of casualties due to land mines, the health and medical services of many poor nations are strained to the breaking point. As noted above, present-day land mines maim their victims rather than kill them outright. Not only is the loss of a limb extremely painful to the victim and his or her family, but recovery is prolonged, and the cost of hospitalization and prostheses is high (amounting to more than a year's income for most victims).

Diplomatic efforts are presently underway to ban production and use of land mines. In the meantime, new, effective technologies for finding, defusing, and removing existing land mines are urgently needed. At present, land mines are typically cleared by tried-and-true methods that date back to World War II: mines-weepers carefully search areas suspected of containing mines with metal detectors and pointed sticks, and extract any mines found. Once unearthed, the mines are detonated or defused. Whatever the methods used to clear land of mines, the successful implementation of these methods depends on the availability of suitable protective apparel for those who carry out this dangerous but essential task.

Since most land mines are activated by pressure, the availability of suitable protective footgear is especially important for those working in an area that contains (or is suspected to contain) undetonated mines. Safety shoes with metal toe caps are well known in the art; indeed, many employers require that their employees wear safety shoes to help prevent on-the-job foot injuries. Many different designs for safety shoes are available, including that disclosed by Scherz in U.S. Pat. No. 4,366,629. Scherz describes a multi-layer safety boot with a sole and upper made of molded plastic material. The boot includes a metallic plate that extends the width and length of the sole, a box-shaped toe guard, and a rigid metatarsal guard.

Safety devices for protecting the feet and lower legs of combat troops and civilians from the effects of blast and fragmentation associated with the detonation of mines (including small antipersonnel land mines) are also known. By way of example, Ringler, et al. (U.S. Pat. No. 4,611,411) disclose a mine-field shoe consisting of a rigid tread made of aluminum with an inflatable, multi-compartment air cushion. The device is attached to the user's boot by straps.

Other types of protective foot-gear are disclosed by Jordan (U.S. Pat. No. 3,516,181), Lewis, Jr., et al. (U.S. Pat. No. 3,243,898), Barron (U.S. Pat. No. 3,061,951), and Krohn, et al. (U.S. Pat. No. 2,720,714). These devices make use of a variety of materials, including foam rubber, fiberglass, rubber sheeting, and building materials such as Dylite® and Celotex® . Jordan's device consists of an armored wedge supported by a rectangular strip of rubber. The wedge is filled with an acoustic filler material (such as Dylite®) which dampens and attenuates shocks transmitted through the sides of the wedge. Lewis, Jr., et al. show a device that includes a plastic platform and a wedge made of metal or laminated fiberglass. The wedge may be reinforced by a fiberglass or Teflon® backing, and is filled with a blast-attenuating acoustic filler material such as Celotex® or balsa wood. It may be mounted in a plastic hull or a balsa-wood block. Barron's blast attenuating footwear includes a layer of non-elastic honeycomb material (made of paper, textile, aluminum, plastic, or rubber) and a rubber outsole. Krohn, et al. provide a protective footpad having a plurality of layers, including layers of natural and synthetic foam rubber, rubberized waterproof fabric, and metal. Adjustable metal heel and toe plates help protect the user's feet from blast injuries. All of these devices are strapped to the user's shoes or boots for use.

Presently-available designs for protective footgear tend to be cumbersome to wear, of relatively complex construction, and expensive to manufacture. Designs that provide reasonably effective protection typically cost hundreds of dollars per pair, and are simply not affordable in those parts of the world where the need for protective footgear is greatest; more affordable designs offer the user little protection against modern antipersonnel mines. There is a need for protective footgear which is simple and easy to make, cost-effective, and provides its wearer with a significant degree of protection against foot and lower leg injury due to land mine explosions.

SUMMARY OF THE INVENTION

According to its major aspects and broadly stated, the present invention is a device that protects the foot and lower leg of its wearer from injury due to exploding land mines. The device may be formed into protective footgear having a conventional appearance, such as an overshoe; alternatively, the device may be assembled by cutting and folding a suitable multilayered material into a box-like structure that is worn over the user's regular shoe or boot.

A device according to the invention has a multilayered structure, including sheets of selected materials that, in combination, substantially dissipate the shock of an exploding land mine and thereby reduce the risk of injury to the wearer. Such a device is relatively light-weight, flexible, and reasonably comfortable to wear while walking. The device is easy to manufacture of readily-available materials, reusable and repairable, and provides remarkably effective protection against blast and shrapnel injuries caused by exploding land mines.

A major feature of the present invention is the multilayered construction of the device. In a preferred embodiment of the invention, the device is made of a multilayered material that includes a heat-resistant layer of Fiberglas® or other suitable textile, a water-impermeable layer or natural or synthetic rubber, and a puncture-resistant layer of Kevlar®. The device may also include one or more steel-reinforced sole plates of thick rubber or like material. In one preferred embodiment of the invention, the device also includes a layer of compressible, impact-absorbing material such as foam rubber, glass foam, or glass fiber. These materials are selected and arranged so that the combination provides a significant degree of protection against the shock, heat, and shrapnel of an exploding mine.

An important feature of the present invention is the selection of materials used therewith: aramid fibers such as Kevlar® contribute puncture-resistance (to stakes, shrapnel, bomb fragments, etc.); Fiberglas®, Thermoglass® or like materials provide heat-resistance; rubber (or some other substantially water-impermeable material) helps prevent excessive moisture absorption that can result in deterioration of the device; and foam rubber, Celotex®, or Fiberglas® foam, if present, help absorb the shock of an exploding mine.

Another important feature of the present invention is its cost-effectiveness and ease of manufacture. The device may be made in a "one-size-fits-all" version to wear as an overshoe; alternatively, a range of sizes may be provided if preferred. It may be shaped in the form of a conventional shoe or boot, or (more economically) as an easy-to-assemble box-like structure that is worn over the user's everyday footgear. (As used herein, the terms "overshoe," "protective shoe," and "protective footgear" refer to any protective foot covering, whether such covering is worn alone or over conventional footgear.) In a preferred embodiment of the invention, a kit includes all the items needed for making a pair of protective overshoes, including extra materials to allow for repairs that may be needed later.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
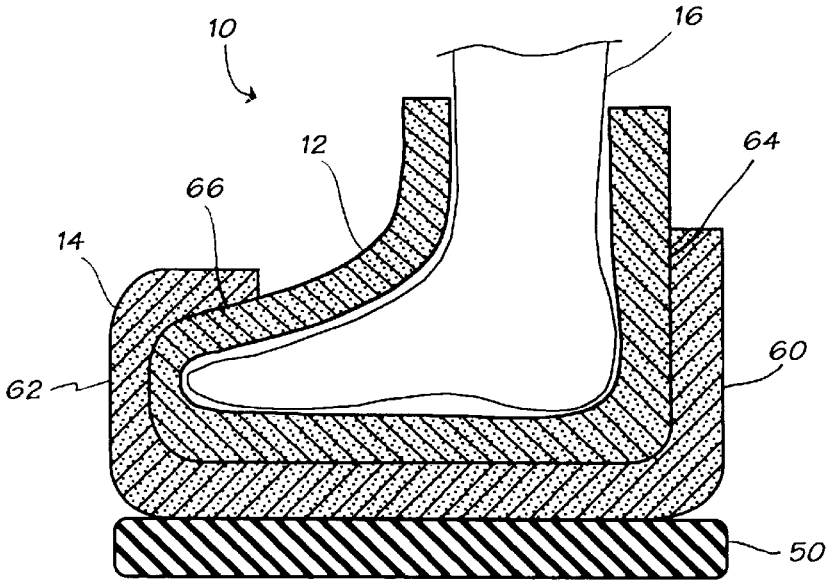
FIG. 1 is a cross-sectional view of a protective device according to a preferred embodiment of the present invention.

In the following detailed description of the invention, reference numerals are used to identify structural elements, portions of elements, or surfaces in the drawings, as such elements, portions or surfaces may be further described or explained by the entire written specification. For consistency, whenever the same numeral is used in different drawings, it indicates the same element, portion, surface and area as when first used. As used herein, the terms "horizontal," "vertical," "left," "right," "up," "down," as well as adjectival and adverbial derivatives thereof, refer to the relative orientation of the illustrated structure as the particular drawing figure faces the reader. It should be understood that only those components having particular functional importance or that would not otherwise be identified have been assigned reference numerals.

Referring now to FIG. 1, there is shown a cross-sectional view of a protective device 10 according to a preferred embodiment of the present invention. Device 10 includes an inner layer 12 and an outer layer 14, and is shaped into an overshoe to protect a foot and lower leg 16 of the wearer. Layers 12 and 14 are multilayer materials that, in combination, substantially attenuate the force of a detonating land mine and thereby protect the wearer's foot and lower leg from injuries due to blast, shrapnel, flying debris, etc.

Figure 2A:
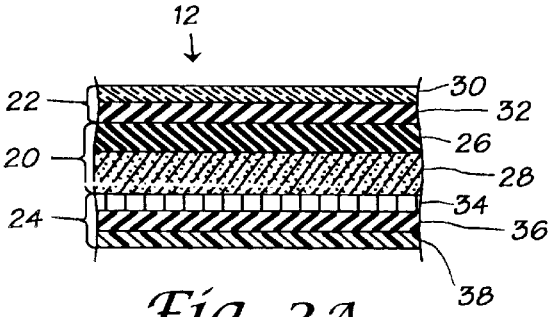
FIG. 2A is a cross-sectional view of the inner layer of the device of FIG. 1.

Inner layer 12 of device 10 includes a compressible layer 20 sandwiched between two layers 22, 24 (FIG. 2A). Layer 20 is made of a compressible, lightweight, impact-absorbing material, preferably, at least two such layers 26, 28 of different materials. It has been determined that a compressible layer 20 which is itself made up of a plurality of layers having different compressibilities affords better blast protection to the wearer of device 10 than does a single such layer. Layer 20 is typically approximately 1–2" (about 2.5–5.0 cm) thick; however, the optimum thickness of layer 20 depends on the particular selection of materials, and is best determined by a modest amount of experimentation and observation for each application.

Layer 20 is made of a light weight, relatively soft material (or materials) having low sonic propagation velocity. Suitable materials include natural or synthetic foam rubber, fibrous silica, glass foam and glass fiber materials such as Fiberglas®, noncombustible foamed plastics, sponge rubber, balsa wood, acoustic filler materials such as Celotex®, Dylite®, and Silitex®, and so forth.

At least one of layers 22, 24 includes a layer of flexible, substantially water-impermeable material; the other of layers 22, 24 includes a layer of a puncture-resistant material such as Kevlar®. Like layer 20, layers 22, 24 are preferably multilayered in structure (FIG. 2A). Thus, layer 22 may include a first, heat-resistant layer 30 and a second, water-impermeable layer 32. Layer 24 may include a heat-resistant layer 34, a water-impermeable layer 36, and a lowermost layer 38 of puncture-resistant material. Layer 38 may be Kevlar®; however other materials (including but not limited to other aromatic polyamide fibers) with extremely high tensile strength and elongation resistance may also be suitable for use with the invention.

Layers 30, 34 are flexible, heat-resistant, corrosion-resistant materials such as glass or ceramic fiber textiles. Such materials are typically inorganic, with high dielectric strength, high tensile strength and low thermal conductivity, and are resistant to most chemicals. Preferably, layers 30, 34 are heat-resistant to at least approximately 1,000° F. (about 538° C.), with thermal conductivities less than approximately 1.0 Btu/h $ft^2$ (about 0.15 W/m °K.) at that temperature. Suitable textiles include Thermoglass® (made by the Amatex Corporation of Norristown, Pa.), Fiberglas® (made by Owens-Corning), Cer-Wool® (made by Premier Refractories and Chemicals, Inc.), and Thermotect®. Other materials that may be useful include those used for high-temperature insulation applications, such as Fiberfrax® (a light-weight, resilient ceramic fiber made from alumina and silica that retains its properties at temperatures as high as 2300° F. (about 1260° C.) and Siltemp® (a substantially pure fibrous silica material).

Layers 32, 36 are a flexible, substantially water-impermeable material (or materials) such as natural or synthetic rubber; alternatively, these layers may be made of rubberized cloth. Layers 32, 36 help prevent excessive moisture absorption that may eventually result in deterioration of device 10.

Figure 2B:
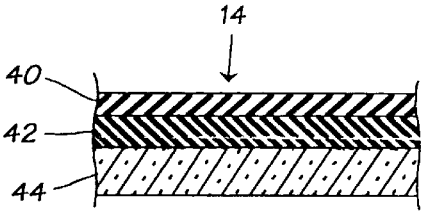
FIG. 2B is a cross-sectional view of the outer layer of the device of FIG. 1.

Outer layer 14 (FIG. 2B) include a compressible layer 40, a water-impermeable layer 42, and a heat-resistant layer 44. Layer 40, like above-described layer 20, is made of a light weight, compressible material (such as natural or synthetic rubber or foam rubber, fibrous silica, glass foam and glass fiber materials such as Fiberglas®, noncombustible foamed plastics, sponge rubber, acoustic filler materials such as Celotex®, Dylite®, and Silitex®, balsa wood, etc.). Layer 42 is a flexible material such as natural or synthetic rubber, and layer 44 is preferably a glass or ceramic fiber textile as described above. If desired, outer layer 14 may also include a puncture-resistant layer of Kevlar® or other suitable material (not shown).

The layers that, together, comprise inner layer 12 and outer layer 14 are bonded together by a high-temperature adhesive that retains its bonding strength to at least several hundred degrees Celsius. Inorganic silica-boric acid mixtures or cements that produce bonds having high strength above 1000° F. (about 538° C.) are preferred; however, rubber-based adhesives may also be suitable. Most preferably, the adhesive is a type that has a lap-bond strength of at least approximately 2000 psi at 1000° F. Such adhesives are available for use in the aerospace industry.

If desired, device 10 may include one or more layers 50 of natural or synthetic rubber (FIG. 1). Layers 50, if present, are approximately ¼–1" (about 0.6–2.5 cm) thick, and may be glued to the bottom of device 10 or attached thereto by suitable fasteners (bolts, screws, snap fasteners, etc.).

In a preferred embodiment of the present invention, device 10 is shaped as an overshoe so that outer layer 14 has a heel portion 60 and a toe portion 62 which enclose heel 64 and toe 66, respectively, of inner layer 12. Inner layer 12 extends upwards to protect the wearer's lower leg, while heel and toe portions 60, 62 provide added protection for the foot which tends to be closest to the epicenter of the blast. As will be described further below, device 10 may also include suitably-positioned steel plates for additional protection.

Device 10 may, of course, be sized so that it can be worn in place of the user's customary shoes or boots. Such a device would, like conventional footgear, have an interior shaped to accommodate the user's foot, and may include fasteners to help secure it in position (buckles, Velcro® tabs, laces, etc.). However, it is believed that device 10 is most economically manufactured as an overshoe that can be worn alone or over regular shoes or boots. Thus, the outer dimensions of the device will generally be somewhat larger than the dimensions of most adult footgear. Device 10 may be made in a single size suitable for most adults, or in a few standard sizes that accommodate most users. This relatively large size of device 10 also distributes the user's weight over a larger surface area, thereby exerting a lower unit pressure upon the ground and reducing the risk of triggering concealed land mines.

Wearing a pair of devices 10, the user can walk through areas suspected of containing unexploded land mines with a greatly reduced risk of exploding the mines. When explosions do occur, the multilayer construction of device 10 (including as it does both compressible layers and puncture-resistant layers) greatly attenuates the force of the blast so that injury is less likely to occur. Furthermore, any injuries that do occur despite the use of device 10 are generally less severe than would be suffered in the absence of protection.

Figure 3:
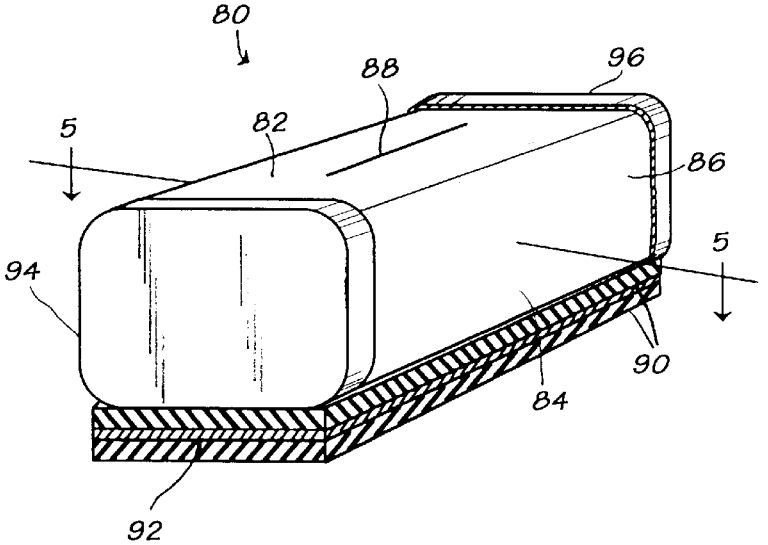
FIG. 3 is a perspective view of a protective device according to another preferred embodiment of the present invention.

Another protective device 80 according to the present invention consists of a generally box-like structure with a top wall or upper 82, a bottom wall or sole 84, and a side wall 86 (FIG. 3). A slit 88 through upper 82 permits insertion of the wearer's foot. Device 80 may include one or more layers 90 (similar to above-described layers 50) of natural or synthetic rubber, attached to sole 84 by any suitable means. Layers 90 may be glued to sole 84, or (preferably) attached thereto by bolts, screws, snaps, or other suitable fasteners.

For additional protection, device 80 may be provided with metal protective plates such as a toe cap 94, a heel cap 96, and one or more sole plates 92. Plates 94, 96, 98, if present, are of 25-gauge steel or other suitable metal.

Figure 4:
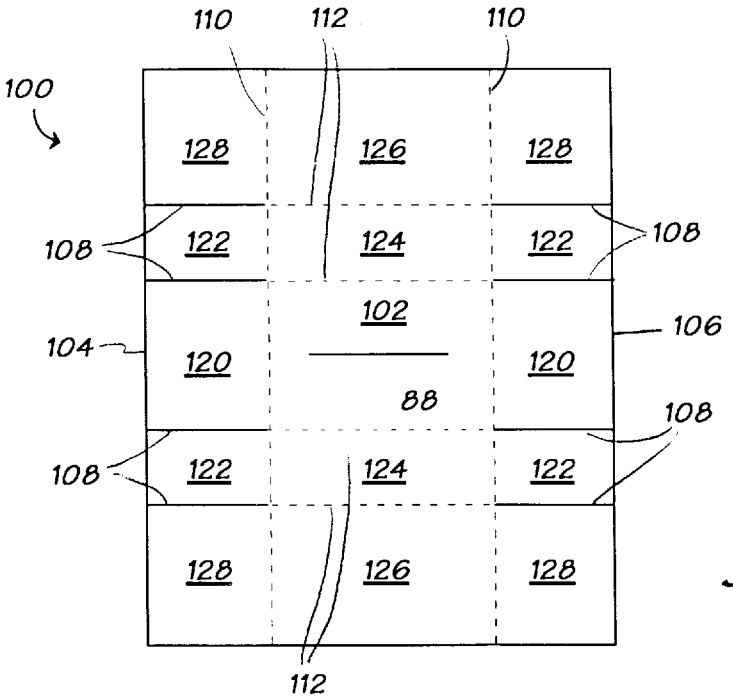
FIG. 4 shows the upper portion of the device of FIG. 3 prior to assembly thereof.

Device 80 may be fabricated by cutting and folding a rectangular, multilayered sheet such as sheet 100 (FIG. 4). Sheet 100, which has a central section 102 corresponding to upper 82, is large enough to provide material for all of walls 82, 84, 86. Each of two sides 104, 106 of sheet 100 is cut in four places (indicated at 108). Then, sheet 100 is folded inwards along lines 110 and 112 to form a box wherein sections 120, 122, 124 are approximately perpendicular to central section 102 with sections 122 overlapping sections 120. Sections 126 are folded approximately perpendicular to sections 124 (that is, parallel to section 102), with sections 128 overlapping sections 122, 120. The result is a device 80 having a side wall 86 with at least three full layers of material at the heel and toe ends (depending on the relative dimensions of sections 122, 120, a fourth full or partial layer may also be present). Sole 84 includes at least two, preferably at least three, full layers of material.

Other cut/fold patterns may also be suitable for use with the invention. Depending on the dimensions of sheet 100 relative to the desired dimensions of device 80, heel and toe portions with two, three, four, or even more layers of material may be constructed from a single sheet. Provided that sections 126, 128 are sufficiently long, extra layers may be made by folding these sections back upon themselves.

Figure 5:
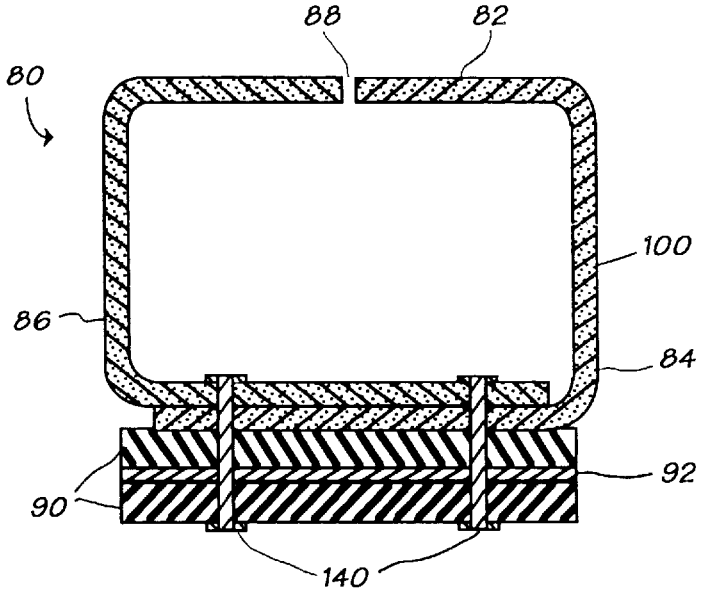
FIG. 5 is a cross-sectional view of the device of FIG. 3, taken along the line 5—5 of FIG. 3.

If desired, protective device 80 may include one or more sheets of rubber or other resilient material 90, attached thereto by screws 140 or other suitable fasteners (FIG. 5). An inner liner (not shown) that approximately conforms to the shape of the user's foot may be inserted into the device for added comfort.

Figure 6:
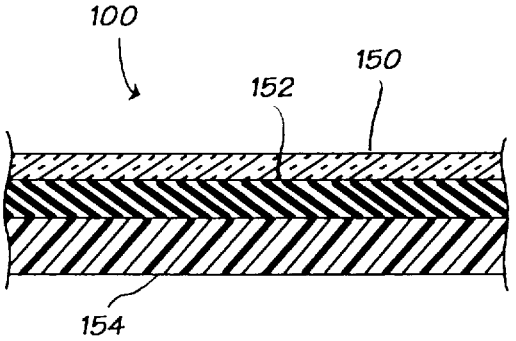
FIG. 6 is a cross-sectional view of a multilayer material suitable for use with the device of FIG. 3.

Referring now to FIG. 6, sheet 100 is preferably a multilayered material (as are layers 12, 14 of above-described device 10). Sheet 100 includes a heat-resistant layer 150, a flexible, substantially water-impermeable layer 152, and a puncture-resistant layer 154 of Kevlar® or other suitable material. Layer 150, like above-described layers 30, 34, is preferably made of a flexible, heat-resistant textile such as Thermoglass®, Fiberglas®, Cer-Wool®, Thermotect® or the like. Layer 152 is natural or synthetic rubber sheeting; however, rubberized cloth or other substantially water-impermeable materials may also be useful. Layers 150, 152, 154 are bonded together by any suitable high-temperature adhesive.

Slit 88 in upper 82 is generally on the order of 12–15" (about 30–38 cm) long. Slit 88 allows easy insertion of the wearer's foot (shod or unshod), but is short enough that device 80 does not easily slip off while walling.

Device 80 is simple and easy to manufacture, and, depending on the particular selection of materials for sheet 100, may cost well under $100.00 per pair. Device 80 may be supplied ready-made. However, to reduce costs and maximize the availability of the device, it may be supplied in the form of a kit that includes the items needed for making a pair of protective overshoes a suitable quantity of sheet 100, the desired number of rubber sheets 90, metal sole and toe plates 92, 94, 96, and fasteners 140. To further reduce the cost of device 80, such a kit could include a high-temperature adhesive and discrete sheets 150, 152, 154 that can be cut to size and bonded together by the user. A template (showing cut and fold lines generally as illustrated in FIG. 4) to help the user determine how to cut and fold sheet 100 could also be included, as well as additional metal plates, sheets 90, and fasteners 140 to allow for repairs.

The operation of the present invention is further illustrated in the following nonlimiting examples.

EXAMPLE 1

A device 10 was fabricated with an inner layer 12 consisting of Thermoglass® fiberglass cloth (layer 30), rubber (layer 32), foam rubber (layer 26), resilient Fiberglas® textile resembling surgical cotton (layer 28), Fiberglas® fabric (layer 34), roofing rubber (layer 36), and Kevlar® (layer 38). Outer layer 14 included layers of Silitex® foam (layer 40), rubber sheeting (layer 42), and Fiberglas® fabric (layer 44). Layer 12 was approximately 2" (about 5 cm) thick; layer 14, approximately 1" (about 2.5 cm) thick.

The device withstood a direct land mine explosion (equivalent to 150 grams of explosive) with minimal damage. It is believed that a person wearing such a device would suffer, at most, minor and easily treatable injuries such as bruises and fractures.

EXAMPLE 2

A device 80 was fabricated with a layer 150 of 1500 Denier, 0.018" (about 0.046 cm) thick Kevlar® having a weight of 9.8 oz/yd$^2$ (about 0.33 kg/m$^2$). Layer 152 was 1/16" (about 0.16 cm) thick roofing rubber, and layer 154, Thermoglass® cloth with a thickness of 0.033" (about 0.084 cm), a warp strength of 250 Lbs. (about 113 kg), a fill strength of about 175 Lbs. (about 79 kg), heat-resistance to 1000° F. (about 538° C.). The device included 25-gauge steel plates 92, 94, 96 and two layers 90, each made of ½"-thick rubber. Layers 90 were attached to sole 84 by heavy-duty Teflon® bolts.

The device withstood a direct land mine explosion (equivalent to 150 grams of explosive) without damage. Therefore, it is believed that anyone wearing such a device 80 would not be injured by a direct land mine explosion, except for possible bruises and fractures. It is believed that the device is capable of withstanding explosions of mines containing up to approximately 300 grams of explosive.

Protective footgear according to the present invention is relatively light-weight, flexible, and reasonably comfortable to wear while walking. The invention is made of multilayered materials that, in combination, dissipate the shock of an exploding mine and thereby reduce the risk of injury to the wearer. Furthermore, the device is made of materials that are largely nonconducting (rubber, glass cloth, Kevlar®, etc.). Thus, the invention may also afford protection to electrical workers against injuries due to high voltages and currents. The invention is easy to manufacture of readily-available materials, reusable, and repairable, and provides remarkably effective protection against blast and shrapnel injuries caused by exploding land mines.

It will be apparent to those skilled in the art that many changes and substitutions can be made to the preferred embodiment herein described without departing from the spirit and scope of the present invention as defined by the appended claims.

What is claimed is:

1. A device for protecting the foot and lower leg of a wearer thereof from injury due to accidental detonation of a land mine, said device comprising:

an inner layer having a first compressible layer, said first compressible layer including two layers of different, compressible, light weight materials, a first layer of substantially water-impermeable material engaging a first side of said first compressible layer, a first layer of heat-resistant material engaging a second side of said first compressible layer, and a first layer of aromatic polyamide fiber material engaging said first layer of heat-resistant material; and an outer layer engaging said inner layer, said outer layer having a second compressible layer, a second layer of substantially water-impermeable material engaging a first side of said second compressible layer, and a second layer of heat-resistant material engaging a second side of said second compressible layer, said inner and outer layers shaped to substantially cover the wearer's foot.

2. The device as recited in claim 1, wherein said inner layer is bonded to said outer layer by a high-temperature adhesive.

3. The device as recited in claim 1, wherein said device has a bottom, further comprising at least one rubber layer attached to said bottom.

4. The device as recited in claim 1, wherein at least said inner layer is formed to protect the lower leg of said wearer.

5. The device as recited in claim 1, wherein said first and second layers of heat-resistant material each have a thermal conductivity less than approximately 1.0 Btu/h ft$^2$ at 1,000° F.

6. The device as recited in claim 1, wherein said first and second layers of heat-resistant material are made of glass or ceramic fiber textiles.

7. The device as recited in claim 1, wherein said first and second layers of substantially water-impermeable material are made of rubber or rubberized cloth.

8. The device as recited in claim 1, further comprising a metal sole plate attached to a bottom of said outer layer.

9. The device as recited in claim 1, wherein said first compressible layer is made of a material selected from the group consisting of foam rubber, sponge rubber, fibrous silica, glass foam, glass fiber material, noncombustible foamed plastic, balsa wood, and acoustic filler materials.

10. The device as recited in claim 1, wherein said second compressible layer is made of a material selected from the group consisting of foam rubber, sponge rubber, fibrous silica, glass foam, glass fiber material, noncombustible foamed plastic, balsa wood, and acoustic filler materials.

11. The device as recited in claim 1, further comprising a third layer of heat-resistant material between said first layer of heat-resistant material and said second compressible layer.

12. The device as recited in claim 1, further comprising a layer of puncture-resistant material between said first heat-resistant layer and said second compressible layer.

13. The device as recited in claim 1, further comprising a second layer of aromatic polyamide fiber material between said first heat-resistant layer and said second compressible layer.

* * * * *